US007195517B1

(12) United States Patent
Savicki, Jr.

(10) Patent No.: US 7,195,517 B1
(45) **Date of Patent: *Mar. 27, 2007**

(54) COMPACT ELECTRICAL WIRING SYSTEM

(75) Inventor: Gerald R. Savicki, Jr., Canastota, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/357,563

(22) Filed: Feb. 17, 2006

Related U.S. Application Data

(63) Continuation of application No. 11/032,420, filed on Jan. 10, 2005, which is a continuation-in-part of application No. 10/680,797, filed on Oct. 7, 2003, now Pat. No. 6,994,585.

(51) Int. Cl.
*H01R 13/60* (2006.01)

(52) U.S. Cl. ..... 439/535; 439/536; 174/58

(58) Field of Classification Search ..... 439/535, 439/536, 650, 107; 174/58
See application file for complete search history.

(56) References Cited

U.S. PATENT DOCUMENTS 5,266,039 A * 11/1993 Boyer et al. ..... 439/107
5,281,154 A * 1/1994 Comerci et al. ..... 439/107
5,472,350 A * 12/1995 Mehta ..... 439/107
6,657,144 B2 * 12/2003 Savicki et al. ..... 200/296

* cited by examiner

*Primary Examiner*—Tho D. Ta
(74) *Attorney, Agent, or Firm*—Daniel P. Malley; Bond Schoeneck & King PLLC

(57) ABSTRACT

The present invention is directed to a electrical wiring system that includes a plug connector having a plurality of plug contacts configured to terminate a plurality of wires. The system also includes an electrical wiring device having a cover member, a body member, a ground strap assembly disposed between the cover member and the body member, and a receptacle formed in a rear portion of the body member, the receptacle being configured to accept the plug connector. The ground strap assembly is configured to conform to at least one body member feature such that a distance from the ground strap assembly to a major rear surface of the body member is less than a predetermined distance. The receptacle includes a plurality of receptacle contacts configured to mate with the plurality of plug contacts when the plug connector is inserted into the receptacle.

38 Claims, 7 Drawing Sheets

COMPACT ELECTRICAL WIRING SYSTEM

CROSS-REFERENCE TO RELATED APPLICATIONS

This is a continuation of U.S. patent application Ser. No. 11/032,420 filed on Jan. 10, 2005, which is a continuation-in-part of U.S. patent application Ser. No. 10/680,797 filed on Oct. 7, 2003, now U.S. Pat. No. 6,994,585, the contents of which is replied upon and incorporated herein by reference in their entirety, and the benefit of priority under 35 U.S.C. §120 is hereby claimed.

BACKGROUND OF THE INVENTION

1. Field of the Invention

The present invention relates generally to electrical devices, and particularly to electrical wiring devices.

2. Technical Background

Electrical circuit installation is a labor intensive and time consuming process that may require electricians of various skill levels. Essentially, the process includes several phases. The first phase is commonly referred to as the rough-in stage. The second stage may be referred to as the termination phase.

During the rough-in stage either conduit or armored cable is placed throughout the structure as per the build-out plans. Junction boxes and wiring device boxes are also installed throughout the structure. Junction boxes are deployed to house connection points where two or more conductors are to be joined. Wiring device boxes are deployed at locations where electrical service is desired. After the boxes have been placed in the structure, the electrical cabling is pulled through the conduits. At the end of this step in the process, electrical wiring is disposed between the distribution panel and each wiring device box. The leads from the electrical wiring extend from the boxes and are visible and accessible for the next phase of the installation process.

As noted above, after the rough-in process is complete the electrical devices must terminated, i.e., the electrical wires are connected to the electrical wiring devices. Accordingly, each electrical wire is stripped and connected to the terminals of the electrical device.

There are drawbacks to the process described above. One drawback relates to the rough-in phase of the process, while another drawback relates to the termination phase. With regard to the rough-in phase, in conventional grounding circuits, the conduit system is employed as the grounding path. The conduit system is grounded at the service entrance and connected to intervening sub-panels, grounded structures, and other grounded equipment. While this grounding method affords protection to both personnel and equipment, it may be problematic from an electromagnetic (EMI) standpoint. In particular, the conduit system may function as an antenna that receives electromagnetic noise propagating in the environment. The electromagnetic noise is transmitted by the conduit system as EMI. As those skilled in the art will recognize EMI may adversely affect the performance of electronic equipment such as computers, telecommunications equipment, testing and calibration equipment, and solid state cash registers, to name a few non-limiting examples.

With regard to the termination phase of the installation process, this aspect of the installation process is the most time consuming portion of the process, and hence, the most costly. A journeyman electrician must perform or supervise the termination of each wiring device.

Accordingly, what is needed is an efficient, labor saving, and cost-effective system for terminating electrical devices to the electrical wiring system. Further, what is also needed is an electrical circuit installation system and method that prevents the propagation of electromagnetic noise within a structure's conduit system.

SUMMARY OF THE INVENTION

The present invention addresses the needs identified above. The present invention provides an efficient, labor saving, and cost-effective system for terminating electrical devices to the electrical wiring system. Further, the present invention provides an electrical circuit installation system and method that prevents the propagation of electromagnetic noise within a structure's conduit system.

One aspect of the present invention is directed to a electrical wiring system that includes a plug connector having a plurality of plug contacts configured to terminate a plurality of wires. The system also includes an electrical wiring device having a cover member, a body member, a ground strap assembly disposed between the cover member and the body member, and a receptacle formed in a rear portion of the body member, the receptacle being configured to accept the plug connector. The ground strap assembly is configured to conform to at least one body member feature such that a distance from the ground strap assembly to a major rear surface of the body member is less than a predetermined distance. The receptacle includes a plurality of receptacle contacts configured to mate with the plurality of plug contacts when the plug connector is inserted into the receptacle.

In another aspect, the present invention is directed to an electrical wiring system that includes a plug connector having a connector body. The connector body has a plurality of plug contacts disposed therein. The plurality of plug contacts are configured to terminate a plurality of wires. An electrical wiring device includes a cover member, a body member, a mounting assembly disposed between the cover member and the body member, and a receptacle disposed in a rear portion of the body member and configured to accept the plug connector. The mounting assembly includes at least one support structure configured to conform to a least one body member feature such that a distance from the mounting assembly to a major rear surface of the body member is less than a predetermined distance. The mounting assembly also includes a ground plate coupled to a ground contact disposed within the receptacle. The receptacle includes a plurality of receptacle contacts. The plurality of receptacle contacts and the ground contact are configured to mate with the plurality of plug contacts when the plug connector is inserted into the receptacle.

In yet another aspect, the present invention is directed to an electrical wiring system that includes a plug connector having a plurality of plug contacts. The plug connector is configured to terminate a plurality of wires. An electrical wiring device includes a cover member, a body member having a back major surface, and a ground strap disposed between the cover member and the body member. The body member includes a receptacle configured to accept the plug connector. The receptacle includes a plurality of receptacle contacts configured to mate with the plurality of plug contacts when the plug connector is inserted into the receptacle. A distance from the ground strap to the back major surface is less than 2.0 inches.

In yet another aspect, the present invention is directed to an electrical wiring system that includes a plug connector including a plurality of plug contacts. The plug connector is configured to terminate a plurality of wires. The system also includes an electrical wiring device having a cover member, a body member having a major rear surface, and a mounting assembly disposed between the cover member and the body member. The mounting assembly includes an EMI attenuation element. The body member includes a receptacle configured to accept the plug connector. The receptacle includes a plurality of receptacle contacts configured to mate with the plurality of plug contacts when the plug connector is inserted into the receptacle.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
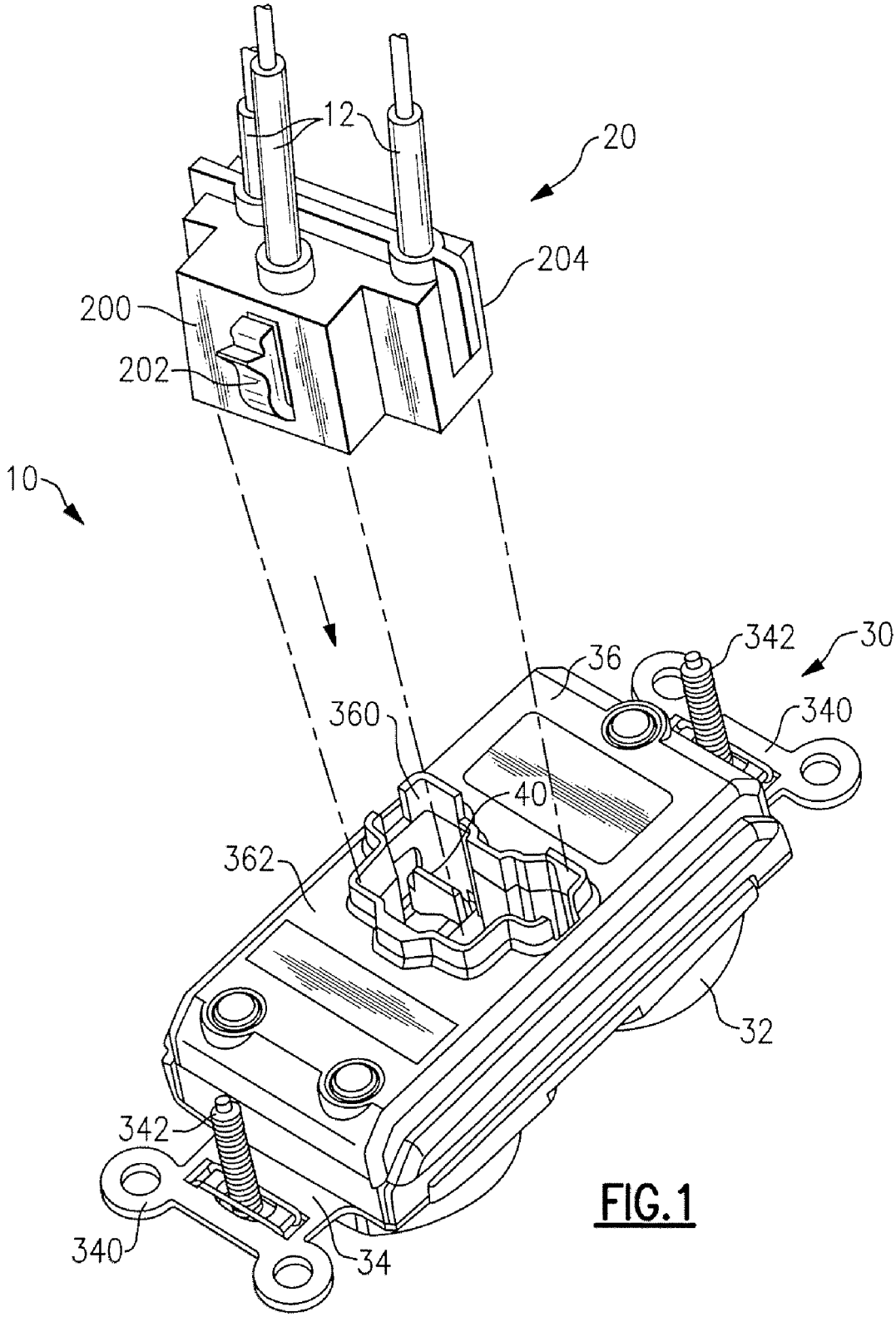
FIG. 1 is a perspective view of an electrical wiring system in accordance with an embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the electrical wiring system of the present invention is shown in FIG. 1, and is designated generally throughout by reference numeral 10.

In accordance with the invention, the present invention is directed to an electrical wiring system that includes a plug connector including a plurality of plug contacts. The plug connector is configured to terminate a plurality of wires. An electrical wiring device includes a cover member, a body member, and a ground strap disposed between the cover member and the body member. The body member includes a receptacle configured to accept the plug connector and a plurality of device contacts. The plurality of device contacts are configured to mate with the plurality of plug contacts when the plug connector is inserted into the receptacle. Accordingly, the present invention provides an efficient, labor saving, and cost-effective system for terminating electrical devices to the electrical wiring system. The present invention also provides an electrical circuit installation system and method that prevents the propagation of electromagnetic noise within a structure's conduit system.

As embodied herein, and depicted in FIG. 1, a perspective view of an electrical wiring system in accordance with an embodiment of the present invention is disclosed. As noted above, the wiring system 10 includes plug connector 20 and wiring device 30. The plug connector includes a body member 200 that has contacts disposed therein (not shown in this view). Each plug contact is terminated to one of the plurality of wires 12. Body 200 includes a latch member 202 configured to hold the plug connector in-place within the body 36 of wiring device 30. Wiring device 30 includes a cover 32, a body 36, and a generally planar ground strap 34 that is disposed between cover 32 and body 36. As shown, the planar ground strap includes a proximal mounting yoke 340 and a distal mounting yoke 340 disposed on opposing ends of ground strap 34. Mounting screws 342 are employed to mount the wiring device to a structure. Referring back to body member 36, a receptacle 360 in formed in the major rear surface 362. A portion of the wiring device contact assembly 40 is accessible via the receptacle 360. Indeed, receptacle 360 is configured to accept the plug connector 20. The wiring device contacts 40 are configured to mate with the plurality of plug contacts (not shown in this view) when the plug connector 20 is inserted into the receptacle 360.

Figure 2:
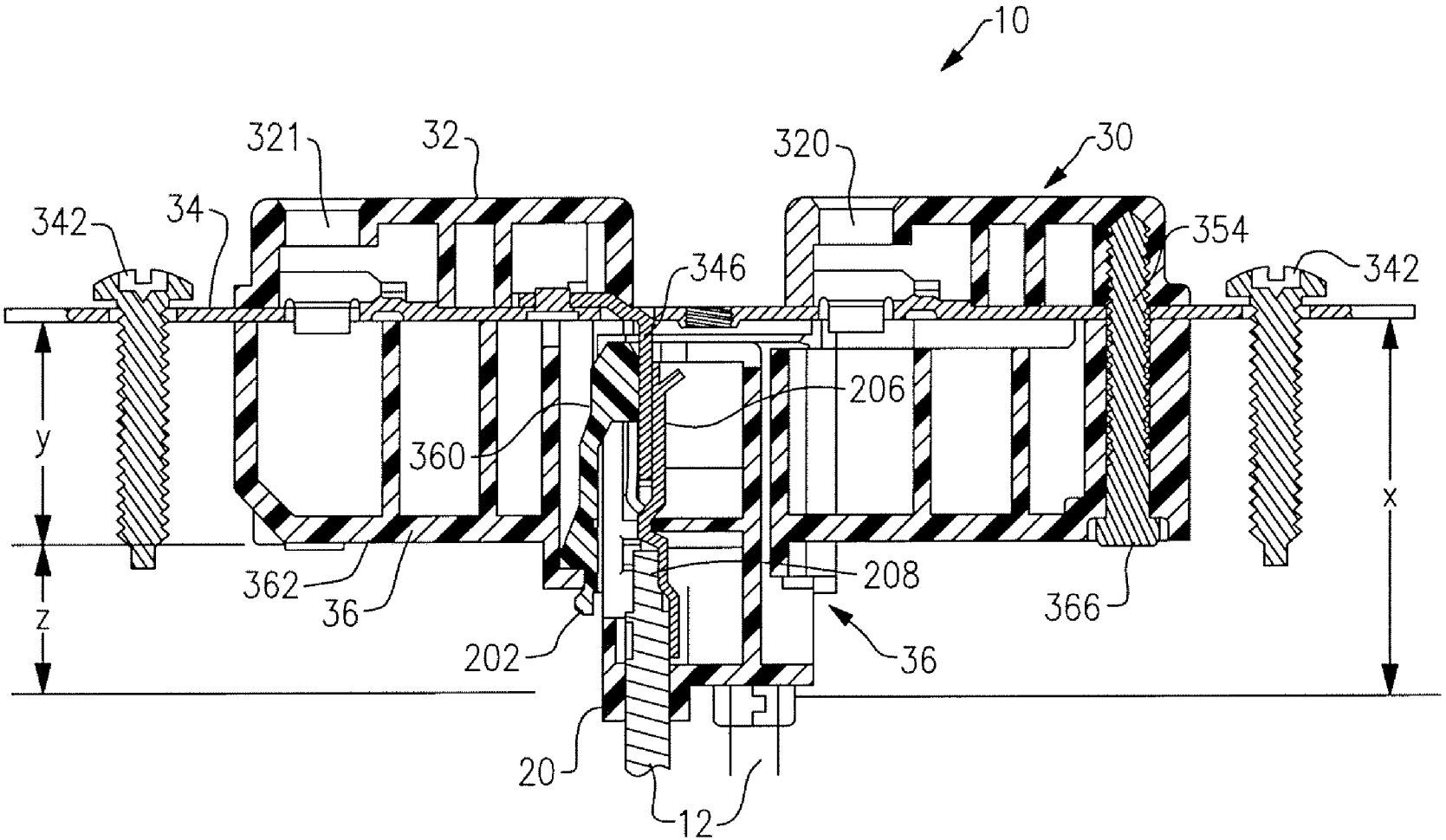
FIG. 2 is a cross-sectional view of the electrical wiring system shown in FIG. 1 with the plug connector inserted into the receptacle.

FIG. 2 is a cross-sectional view of the electrical wiring system 10 shown in FIG. 1 with the plug connector inserted into the receptacle. Cover 32, ground strap 34, and body member 36 are joined together as a single unit 30 by inserting screws 366 into holes 364 disposed in body member 36. Screws 366 pass through the holes 354 disposed in ground strap 34 and are tightened by screw threads disposed in cover 32.

In FIG. 2, plug connector 20 is inserted into receptacle 360. Plug body 200 fits snugly into receptacle 360. When fully inserted, latch member 202 prevents plug body 200 from disengaging receptacle 360. In the interior portion of plug body 200, wires 12 are connected to plug contacts 206 at termination point 208. The plug contact depicted in FIG. 2 is a ground contact that is engaged with receptacle ground contact 346. In one embodiment of the present invention, there is electrical continuity between wire 12, contact 206, device contact 346, and ground strap 34. In another embodiment, device ground contact 346 is electrically isolated from ground strap 34. Accordingly, there is only electrical continuity between wire 12, contact 206, and device ground contact 346.

FIG. 2 provides three dimensions. Dimension "x" is a variable dimension from the back of ground strap 34 to the bottom of plug connector 20. The value of dimension "x" is largely dependent on dimension "y", which is the distance from the back of strap 34 to the rear major surface 362 of body 36. Dimension "z" is the distance that a fully inserted plug connector 20 extends from the major rear surface 362 of body 36. Referring back to dimension "y", the distance from the back of strap 34 to the rear major surface 362 of body 36 may vary depending on the functionality of the wiring device 10. If wiring device 10 only includes user accessible receptacles 320, then "y" may equal approximately 0.635". However, in certain instances "y" may be as great as 2.50". In certain embodiments, "z" is approximately 0.436". The thickness of cover member 32 is typically 0.358". A typical thickness of ground strap 34 is approximately 0.042". As noted above, body member 36 may be altered to accommodate any number of electrical wiring devices. Examples of such devices include, but are not limited to, electrical receptacles, various types of switches, ground fault circuit interrupters (GFCIs), and/or arc fault circuit interrupters (AFCIs).

Figure 3:
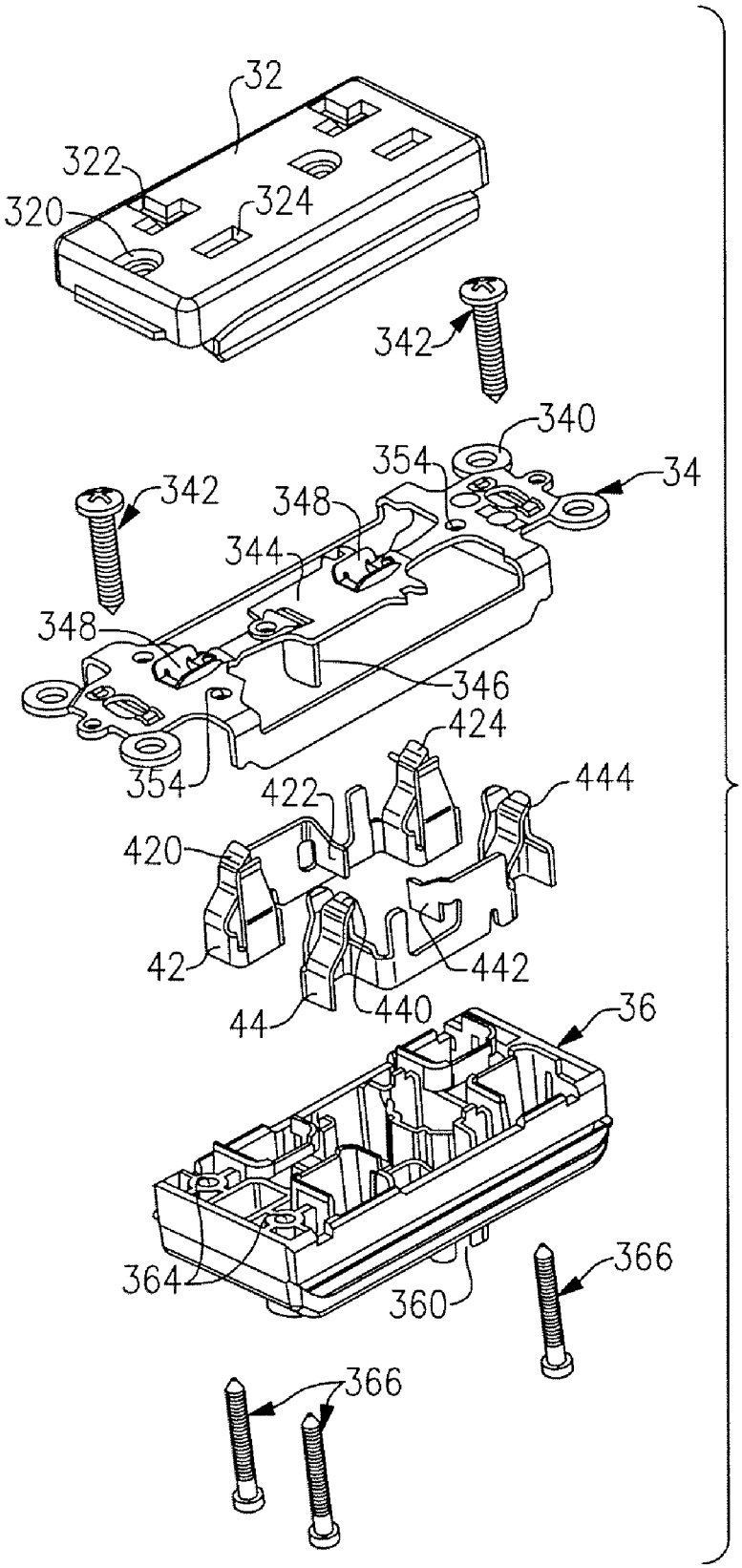
FIG. 3 is an exploded view of a wiring device in accordance with a first embodiment of the present invention.

Referring to FIG. 3, an exploded view of a wiring device in accordance with a first embodiment of the present invention is disclosed. As shown, ground strap 34 is generally planar in nature and includes an aperture on either side of central portion 344 to accommodate neutral contact assembly 42 and hot contact assembly 44. Neutral contact assembly 42 includes user accessible contacts 420 and 424. Neutral contacts 420, 424 are aligned with user accessible neutral blade receptacle 322 in cover 32. Contact 422 is configured to mate with the plug neutral contacts disposed in plug connector 20. Similarly, hot contacts 440, 444 are aligned with user accessible hot blade receptacle 324 in cover 32. Contact 442 is configured to mate with the plug hot contacts disposed in plug connector 20. Note also that planar ground strap 34 includes a ground blade 346 that is configured to mate with the ground contacts disposed in plug connector 20. Cover 32 also includes ground blade receptacle openings 320. Openings 320 are aligned with ground contacts 348 disposed on ground strap 34. As noted above, the wiring device 10 is joined together by screws 366, which are inserted through holes 364 in the body member 36 and holes 354 disposed in ground strap 34. Cover member 32 includes screw threads that accommodate screws 366.

Figure 4A:
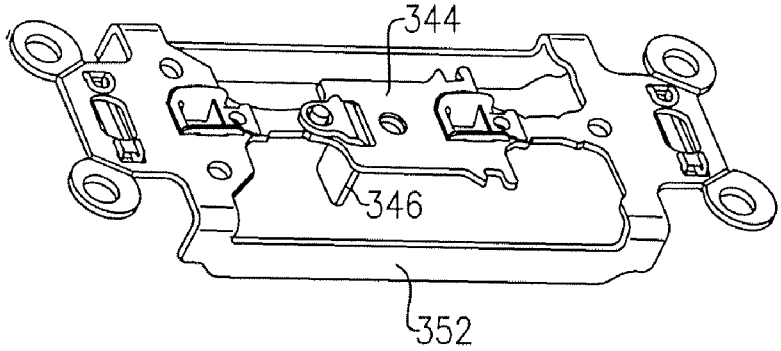
FIG. 4A is a detail view of the ground strap assembly shown in FIG. 3.
Figure 4B:
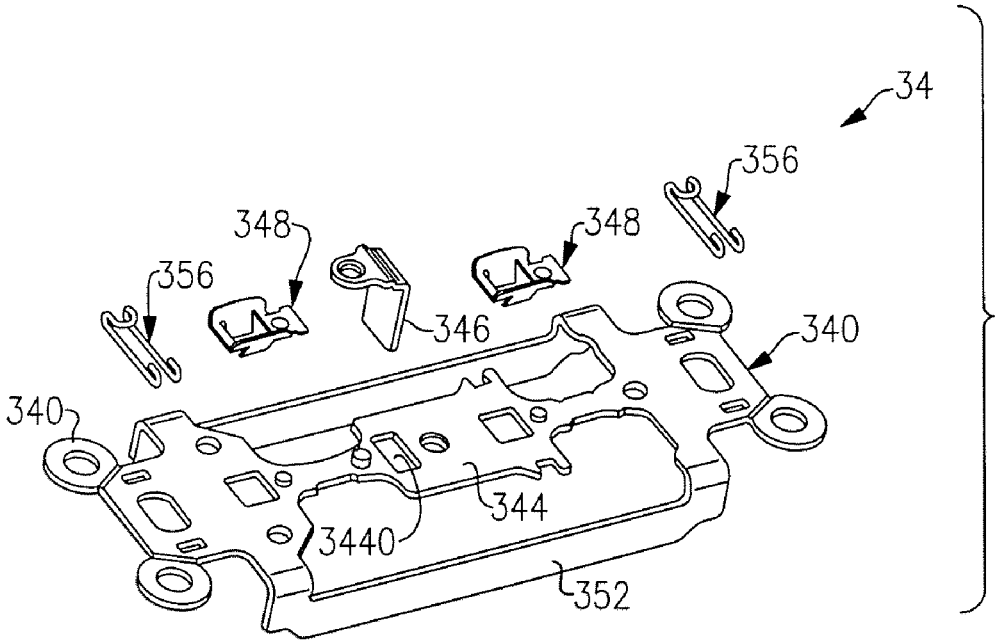
FIG. 4B is an exploded view of the ground strap assembly shown in FIG. 4A.

FIG. 4A is a detail view of the ground strap assembly shown in FIG. 3. FIG. 4B is an exploded view of the ground strap assembly 34 shown in FIG. 4A. Ground strap 34 includes a two mounting yokes 340 that are disposed at a proximal end of the ground strap and a distal end of the ground strap. The mounting yokes are connected along a central axis of the ground strap by central portion 344. The mounting yokes and central portion 344 are disposed in a single plane, i.e., these elements are coplanar. Ground contact 346 is riveted to central portion 344 and is configured to extend through hole 3440 into receptacle 360. Ground contacts 348 are riveted to ground strap 34 on either side of central portion 344. These contacts are aligned with user accessible ground blade apertures formed in cover member 32.

Ground strap 34 also includes two lateral support members 352 that rigidly interconnect the two mounting yokes 340. As shown, the lateral support members 352 are substantially parallel one to the other and disposed along a lateral side portion of the body member perimeter.

Figure 5:
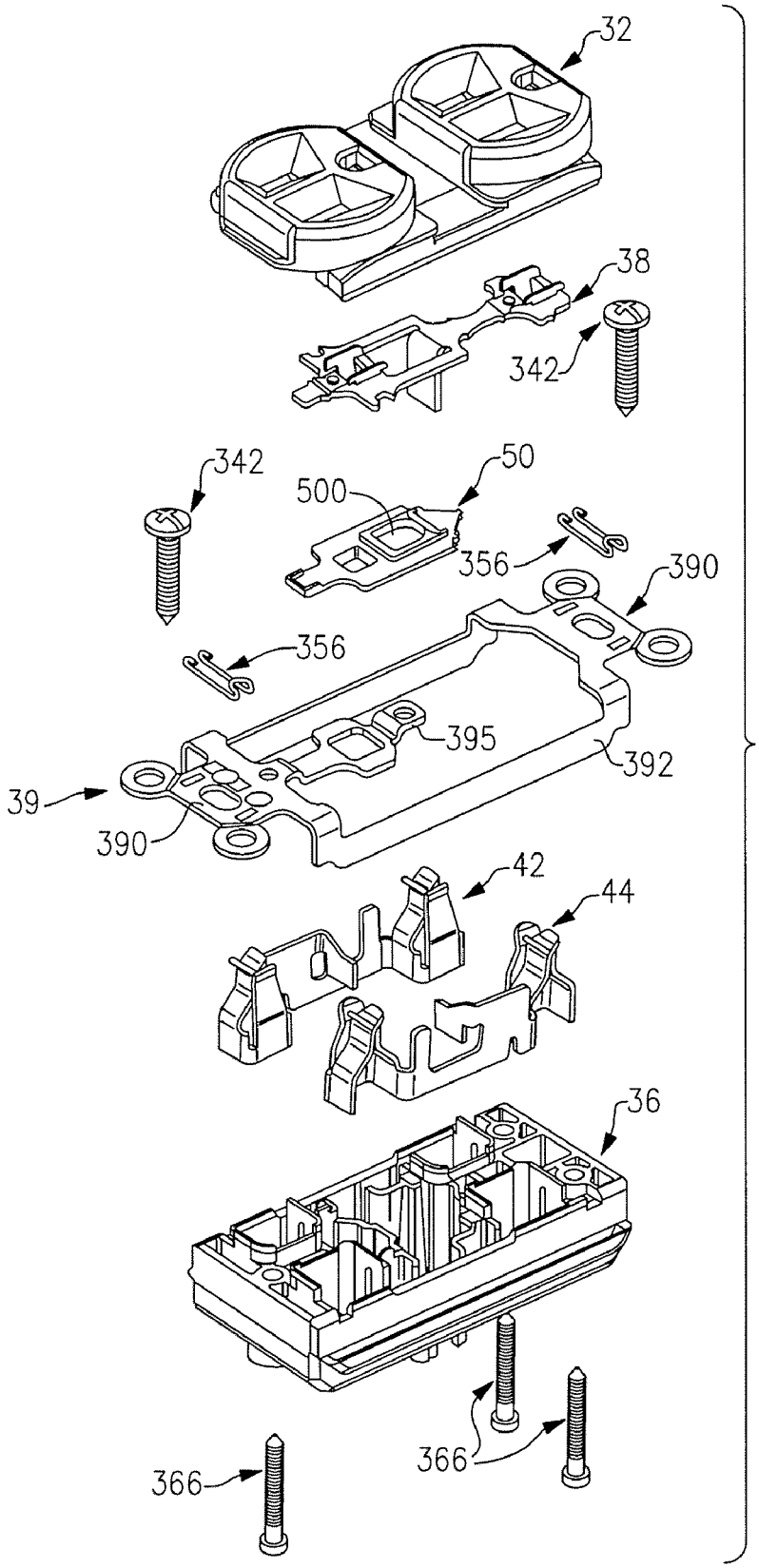
FIG. 5 is an exploded view of a wiring device in accordance with a second embodiment of the present invention.

As embodied herein and depicted in FIG. 5, an exploded view of a wiring device 10 in accordance with a second embodiment of the present invention is disclosed. Of interest in this embodiment is modified ground strap 39, ground plate 38, and insulator member 50. With regard to ground strap 39, the central portion 395 does not interconnect the proximal and distal mounting yokes 390. However, ground strap 39 includes lateral support members 392. Support members 392 are identical to those previously described. Instead of riveting the ground contacts to the ground strap as described in the first embodiment, an isolated ground plate 38 is provided. To provide electrical isolation, insulator member 50 is disposed between the ground plate 38 and the ground strap 39. Accordingly, the mounting yokes 390 are grounded to the conduit system, whereas equipment ground is directly connected to the neutral at the service entrance, by way of the an insulated equipment ground conductor. In essence, the conduit grounding system is electrically isolated from the grounding circuit. This arrangement eliminates the EMI propagating in the conduit system. As such, a relatively noise free grounding path is provided, resulting in improved electronic equipment operation.

Figure 6:
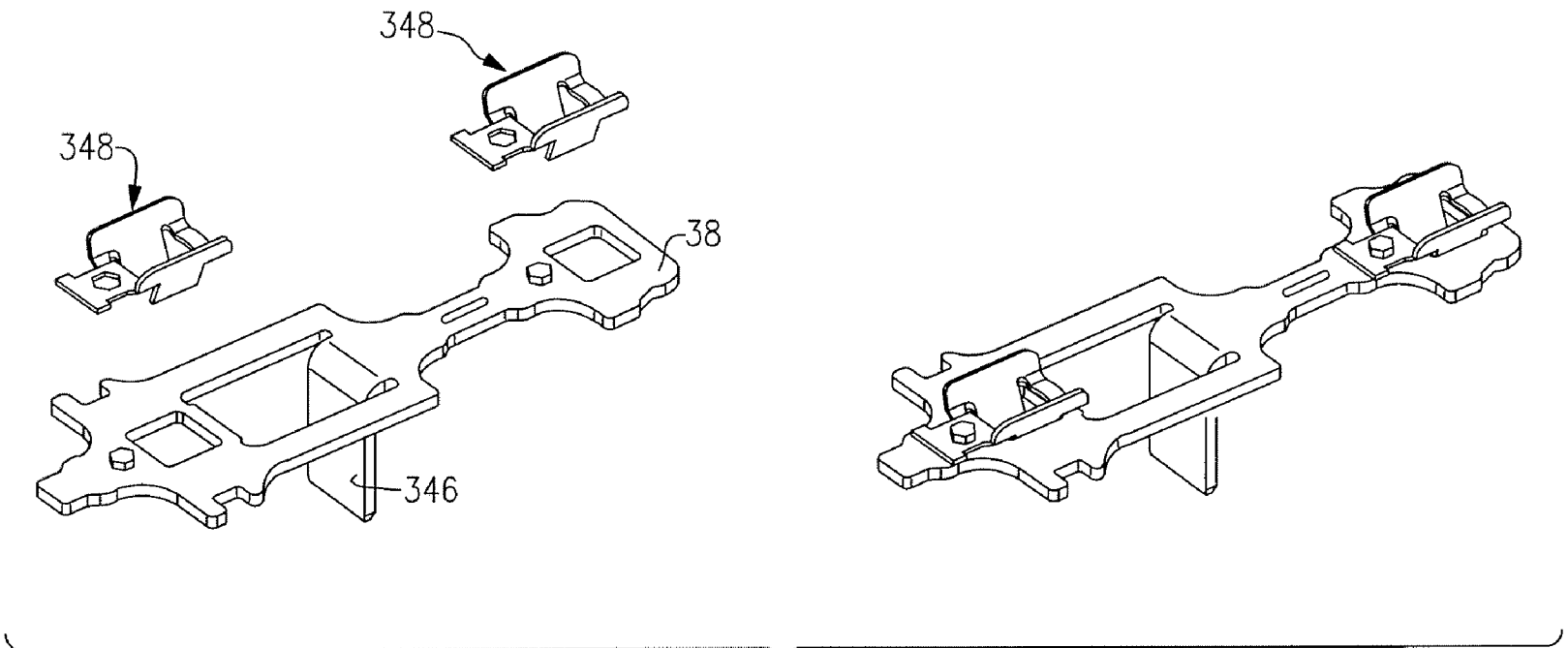
FIG. 6 is a detail view of the isolated ground plate shown in FIG. 5.

FIG. 6 is a detail view of the isolated ground plate shown in FIG. 5. This detail view highlights the fact that user accessible ground contacts 346, 348 are riveted to ground plate 38, instead of to the ground strap 39.

Figure 7:
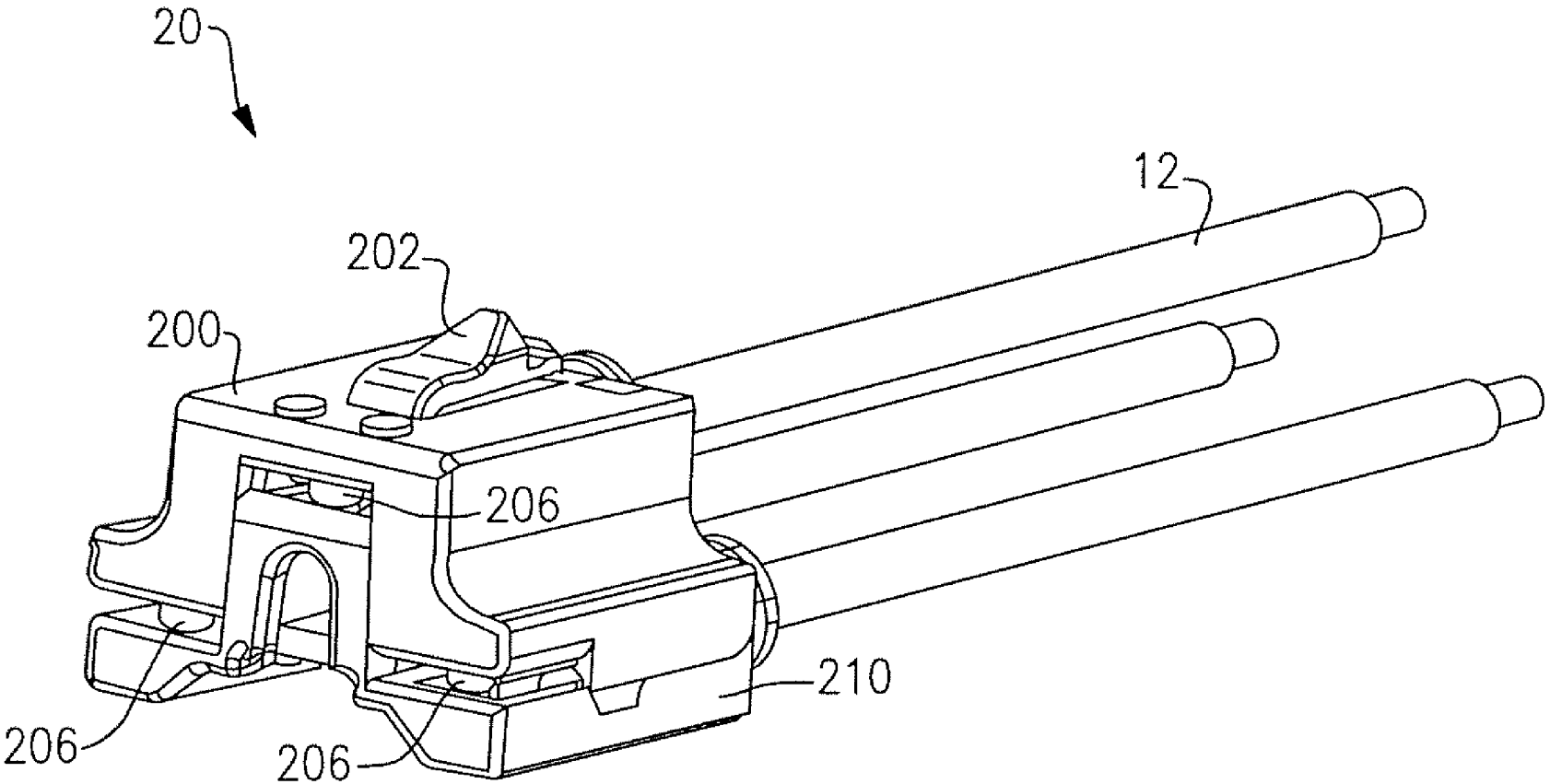
FIG. 7 is a perspective view of a plug connector in accordance with an embodiment of the present invention.

FIG. 7 is a perspective view of a plug connector in accordance with one embodiment of the present invention. Plug connector 20 includes an upper housing 200 and a lower housing 210. The upper housing 200 is snapped onto lower housing 210 to enclose and terminate wires 12 in plug connector 20. In this embodiment, connector 20 includes female plug contacts 206. When wires 12 are terminated, electrical connectivity is established between the female contacts 206 and wires 12. Plug connector 20, as noted previously, includes latch mechanism 202. When the plug connector 20 is inserted into receptacle 360, latch mechanism 202 flexes inwardly until the connector 20 is fully inserted. At that point, the latch 202 relaxes and emits an audible sound that indicates that the plug 20 was successfully inserted into the wiring device 30. Latch mechanism 202 may be flexed to remove plug connector 20 from receptacle 360. Reference is made to U.S. patent application Ser. No. 10/680,797, which is incorporated herein by reference as though fully set forth in its entirety, for a more detailed explanation of the plug connector 20.

It will be apparent to those skilled in the art that various modifications and variations can be made to the present invention without departing from the spirit and scope of the invention. Thus, it is intended that the present invention cover the modification and variations of this invention provided they come within the scope of the appended claims and their equivalents.

What is claimed is:

1. An electrical wiring system comprising:

a plug connector including a plurality of plug contacts configured to terminate a plurality of wires; and an electrical wiring device including a cover member, a body member, a ground strap assembly disposed between the cover member and the body member, and a receptacle formed in a rear portion of the body member, the receptacle being configured to accept the plug connector, the ground strap assembly being configured to conform to at least one body member feature such that a distance from the ground strap assembly to a major rear surface of the body member is less than a predetermined distance, the receptacle including a plurality of receptacle contacts configured to mate with the plurality of plug contacts when the plug connector is inserted into the receptacle.

2. The system of claim 1, wherein the plurality of plug contacts include female contacts and the plurality of receptacle contacts include male contacts.

3. The system of claim 1, wherein the plurality of plug contacts include male contacts and the plurality of receptacle contacts include female contacts.

4. The system of claim 1, wherein the plurality of wires includes an AC phase conductor, an AC neutral conductor, and a ground conductor.

5. The system of claim 1, wherein the electrical wiring device includes at least one user accessible receptacle disposed in the cover member, the at least one user accessible receptacle including a plurality of user-accessible contacts electrically connected with the plurality of receptacle contacts.

6. The system of claim 1, wherein the electrical wiring device includes at least one user accessible electrical switch disposed in the cover member, the at least one user accessible electrical switch being electrically connected with the plurality of receptacle contacts.

7. The system of claim 1, wherein the plug connector includes a plurality of wire segments, each wire segment being electrically coupled to one of the plurality of plug contacts at a first end of the wire segment and electrically coupled to a twist-on connector at a second end of the wire segment, each twist-on connector being configured to terminate one of the plurality of wires.

8. The system of claim 1, wherein the ground strap assembly includes an EMI attenuation element.

9. The system of claim 1, wherein the ground strap assembly further comprises:

a first mounting yoke;

a ground plate portion coupled to the first mounting yoke and substantially disposed along a central axis of the body member; and a second mounting yoke coupled to the ground plate, the first mounting yoke, the second mounting yoke, and the ground plate being substantially co-planar.

10. The system of claim 9, wherein the ground strap further comprises:

a first lateral support member rigidly connecting the first mounting yoke and the second mounting yoke along a first lateral portion of the body member; and a second lateral support member rigidly connecting the first mounting yoke and the second mounting yoke along a second lateral portion of the body member.

11. The system of claim 10, wherein the first lateral support member and the second lateral support member are substantially parallel.

12. The system of claim 9, wherein the ground plate portion is electrically isolated from the first mounting yoke and the second mounting yoke.

13. The system of claim 12, wherein the ground plate portion includes a ground contact disposed within the receptacle, the ground contact and the plurality of receptacle contacts forming a tripartite receptacle contact arrangement configured to mate with the plurality of plug contacts when the plug connector is inserted into the receptacle.

14. The system of claim 13, further comprising an insulator member disposed between the ground strap and the ground plate portion to thereby electrically isolate the ground strap from the ground plate portion.

15. The system of claim 1, wherein the ground strap assembly includes a ground plate portion coupled to a ground contact extending within the receptacle.

16. The system of claim 15, wherein the ground contact and the plurality of receptacle contacts form a tripartite receptacle contact arrangement configured to mate with the plurality of plug contacts when the plug connector is inserted into the receptacle.

17. The system of claim 1, wherein the plurality of receptacle contacts includes a hot conductor contact and a neutral conductor contact, the hot conductor contact being an integral portion of a unitary hot conductor assembly disposed in the body member, the neutral conductor contact being an integral portion of a unitary neutral conductor assembly disposed in the body member.

18. The system of claim 17, wherein the ground strap assembly is disposed in the body member in a predetermined spatial relationship with the unitary hot conductor assembly and the unitary neutral conductor assembly, the body member including a plurality of electrically isolating members configured to electrically isolate the ground strap assembly, the unitary hot conductor assembly, and the unitary neutral conductor assembly.

19. An electrical wiring system comprising:

a plug connector including a connector body having a plurality of plug contacts disposed therein, the plurality of plug contacts being configured to terminate a plurality of wires; and an electrical wiring device including a cover member, a body member, a mounting assembly disposed between the cover member and the body member, and a receptacle disposed in a rear portion of the body member and configured to accept the plug connector, the mounting assembly including at least one support structure configured to conform to a least one body member feature such that a distance from the mounting assembly to a major rear surface of the body member is less than a predetermined distance, the mounting assembly also including a ground plate coupled to a ground contact disposed within the receptacle, the receptacle including a plurality of receptacle contacts, the plurality of receptacle contacts and the ground contact being configured to mate with the plurality of plug contacts when the plug connector is inserted into the receptacle.

20. The system of claim 19, wherein the support structure further comprises:

a first mounting yoke disposed at a proximal end of the electrical wiring device; and a second mounting yoke coupled to the ground plate and disposed at a distal end of the electrical wiring device, the first mounting yoke, the second mounting yoke, and the ground plate being substantially co-planar.

21. The system of claim 19, the ground plate includes an EMI attenuation element.

22. The system of claim 21, wherein the EMI attenuation element electrically isolates a portion of the mounting assembly from the ground contact.

23. The system of claim 22, wherein the EMI attenuation element includes an insulator member disposed between the portion of the mounting assembly and the ground plate, the ground contact being electrically isolated from the at least one support structure by the insulator member.

24. The system of claim 19, wherein the at least one support structure includes a unitary frame member configured to conform to a plurality of external lateral portions of the body member.

25. The system of claim 24, wherein the unitary frame member further comprises:

a first lateral support member disposed along a first lateral portion of the body member; and a second lateral support member disposed along a second lateral portion of the body member.

26. The system of claim 25, wherein the first lateral support member and the second lateral support member are substantially parallel.

27. An electrical wiring system comprising:

a plug connector including a plurality of plug contacts, the plug connector being configured to terminate a plurality of wires; and an electrical wiring device including a cover member, a body member having a back major surface, and a ground strap disposed between the cover member and the body member, the body member including a receptacle configured to accept the plug connector, the receptacle including a plurality of receptacle contacts configured to mate with the plurality of plug contacts when the plug connector is inserted into the receptacle, a distance from the ground strap to the back major surface being less than 2.0 inches.

28. The system of claim 27, wherein the ground strap includes a unitary frame member and a ground plate, the ground plate including a ground contact disposed within the receptacle.

29. The system of claim 27, wherein the distance is less than 1.225 inches.

30. The system of claim 27, wherein the distance is less than 1.0 inches.

31. The system of claim 27, wherein the distance is less than 0.7 inches.

32. The system of claim 27, wherein a distance from the back major surface to a distal end of the plug connector when the plug connector is inserted into the receptacle is approximately 0.5 inches or less.

33. The system of claim 32, wherein the distance is approximately 0.436 inches.

34. The system of claim 27, wherein the ground strap further comprises:

a first mounting yoke disposed at a proximal end of the electrical wiring device;

a second mounting yoke coupled to the ground plate and disposed at a distal end of the electrical wiring device, the first mounting yoke, the second mounting yoke, and the ground plate being substantially co-planar;

a first lateral support member rigidly connecting the first mounting yoke and the second mounting yoke along a first lateral portion of the body member; and a second lateral support member rigidly connecting the first mounting yoke and the second mounting yoke along a second lateral portion of the body member.

35. The system of claim 34, wherein the first lateral support member and the second lateral support member are substantially parallel.

36. An electrical wiring system comprising:

a plug connector including a plurality of plug contacts, the plug connector being configured to terminate a plurality of wires; and an electrical wiring device including a cover member, a body member having a major rear surface, and a mounting assembly disposed between the cover member and the body member, the mounting assembly including an EMI attenuation element, the body member including a receptacle configured to accept the plug connector, the receptacle including a plurality of receptacle contacts configured to mate with the plurality of plug contacts when the plug connector is inserted into the receptacle.

37. The system of claim 36, wherein the mounting assembly includes at least one mounting yoke and a ground plate coupled to a ground contact, the EMI attenuation element being configured to electrically isolate the at least one mounting yoke from the ground plate and the ground contact.

38. The system of claim 37, wherein the EMI attenuation element includes an insulator member disposed between a portion of the mounting assembly and the ground plate.

* * * * *

US007195517C1

(12) INTER PARTES REEXAMINATION CERTIFICATE (756th)

United States Patent
Savicki, Jr.

(10) Number: US 7,195,517 C1
(45) **Certificate Issued: *Dec. 6, 2013**

(54) COMPACT ELECTRICAL WIRING SYSTEM

(75) Inventor: Gerald R. Savicki, Jr., Canastota, NY (US)

(73) Assignee: Pass & Seymour, Inc., Syracus, NY (US)

Reexamination Request:
No. 95/000,258, May 8, 2007

Reexamination Certificate for:

| | |
|---|---|
| Patent No.: | **7,195,517** |
| Issued: | **Mar. 27, 2007** |
| Appl. No.: | **11/357,563** |
| Filed: | **Feb. 17, 2006** |

( * ) Notice: This patent is subject to a terminal disclaimer.

Related U.S. Application Data

(63) Continuation of application No. 11/032,420, filed on Jan. 10, 2005, now Pat. No. 7,189,110, which is a continuation-in-part of application No. 10/680,797, filed on Oct. 7, 2003, now Pat. No. 6,994,585.

(51) Int. Cl.

| | |
|---|---|
| ***H01R 13/60*** | (2006.01) |
| ***H01R 13/658*** | (2011.01) |
| ***H01R 24/00*** | (2011.01) |
| *H01R 13/627* | (2006.01) |

(52) U.S. Cl.
CPC ..... *H01R 13/65802* (2013.01); *H01R 23/10* (2013.01); *H01R 13/6272* (2013.01)
USPC ..... 439/535; 174/58; 439/536

(58) Field of Classification Search
None
See application file for complete search history.

(56) References Cited

To view the complete listing of prior art documents cited during the proceeding for Reexamination Control Number 95/000,258, please refer to the USPTO's public Patent Application Information Retrieval (PAIR) system under the Display References tab.

*Primary Examiner* — Albert J Gagliardi

(57) ABSTRACT

The present invention is directed to a electrical wiring system that includes a plug connector having a plurality of plug contacts configured to terminate a plurality of wires. The system also includes an electrical wiring device having a cover member, a body member, a ground strap assembly disposed between the cover member and the body member, and a receptacle formed in a rear portion of the body member, the receptacle being configured to accept the plug connector. The ground strap assembly is configured to conform to at least one body member feature such that a distance from the ground strap assembly to a major rear surface of the body member is less than a predetermined distance. The receptacle includes a plurality of receptacle contacts configured to mate with the plurality of plug contacts when the plug connector is inserted into the receptacle.

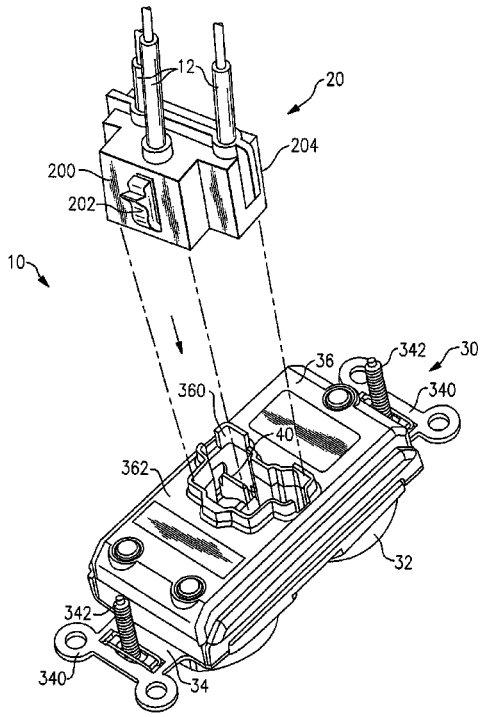

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-38 are cancelled.

* * * * *